US010400476B2

(12) United States Patent
Grillo

(10) Patent No.: US 10,400,476 B2
(45) Date of Patent: Sep. 3, 2019

(54) CROSS CONNECTING LOCKING APPARATUS

(71) Applicant: MAGLOCK, LLC, Pensacola, FL (US)

(72) Inventor: Michael Alan Grillo, Pensacola, FL (US)

(73) Assignee: MAGLOCK, LLC, Pensacola, FL (US)

( * ) Notice: Subject to any disclaimer, the term of this patent is extended or adjusted under 35 U.S.C. 154(b) by 707 days.

(21) Appl. No.: 13/835,948

(22) Filed: Mar. 15, 2013

(65) Prior Publication Data

US 2014/0265358 A1 Sep. 18, 2014

(51) Int. Cl.

| | |
|---|---|
| ***E05B 47/00*** | (2006.01) |
| ***E05B 47/02*** | (2006.01) |
| ***E05C 19/00*** | (2006.01) |
| *G07C 9/00* | (2006.01) |

(52) U.S. Cl.

CPC ..... *E05B 47/0012* (2013.01); *E05B 47/026* (2013.01); *E05C 19/003* (2013.01); *E05B 2047/0094* (2013.01); *G07C 2009/00928* (2013.01); *Y10T 292/1021* (2015.04)

(58) Field of Classification Search

CPC ..... E05B 17/0087; E05B 47/0001; E05B 47/0012; E05B 47/0014; E05B 47/0015; E05B 47/0016; E05B 2047/0036; E05B 2047/0054; E05B 2047/0081; E05B 2047/0094; E05B 47/026; E05B 81/90; E05C 9/04

USPC ..... 292/2, 3, 8–10, 32, 33, 39, 41, 43, 142, 292/160, 144; 70/275, 277, 278.1, 280

See application file for complete search history.

(56) References Cited

U.S. PATENT DOCUMENTS

| | | | | |
|---|---|---|---|---|
| 3,829,834 | A * | 8/1974 | Frankland | G07C 9/0069 292/144 |
| 3,933,382 | A | 1/1976 | Counts et al. | |
| 3,996,591 | A | 12/1976 | Hayward | |
| 4,135,760 | A | 1/1979 | Grossbach | |
| 4,349,223 | A | 9/1982 | Spector | |
| 4,762,350 | A | 8/1988 | Hurtado | |
| 4,986,099 | A * | 1/1991 | Johnson | E05B 47/0012 292/144 |
| 5,253,905 | A | 10/1993 | Hutson | |
| 5,340,172 | A | 8/1994 | Sweet | |
| 5,429,399 | A | 7/1995 | Geringer et al. | |
| 5,473,841 | A | 12/1995 | Grillo | |
| 5,479,341 | A * | 12/1995 | Pihl | G11B 33/1406 340/542 |
| 5,490,696 | A | 2/1996 | Hutson | |
| 6,932,394 | B1 | 8/2005 | Grillo | |

(Continued)

FOREIGN PATENT DOCUMENTS

| | | | |
|---|---|---|---|
| KR | 10-2009-0036088 | 4/2009 | |
| WO | WO 2007057672 A2 * | 5/2007 | E05C 17/446 |

*Primary Examiner* — Alyson M Merlino

(74) *Attorney, Agent, or Firm* — Christopher A. Proskey; BrownWinick Law Firm

(57) ABSTRACT

Embodiments of the subject invention relate to a cross connecting locking apparatus for portals such as doors, gates, entryways, entrances, hatches, ingresses, garage doors, windows, fenestrations, or any other sort of passageway situated in a larger nonmovable structure. Specific embodiments are remotely operated and can be locked or unlocked under a variety of environmental and/or user-activated triggering mechanisms.

18 Claims, 10 Drawing Sheets

(56) References Cited

U.S. PATENT DOCUMENTS

| | | | | |
|---|---|---|---|---|
| 7,059,159 | B2 * | 6/2006 | Lanigan | B62D 33/0222 292/144 |
| 7,484,391 | B1 * | 2/2009 | Moore | B65D 90/008 292/144 |
| 7,637,130 | B2 | 12/2009 | Carr | |
| 7,770,420 | B2 | 8/2010 | Carr | |
| 7,950,748 | B2 * | 5/2011 | Coutermarsh | E05B 51/02 188/353 |
| 8,269,627 | B2 | 9/2012 | Gore et al. | |
| 2004/0055345 | A1 * | 3/2004 | Moore | B60R 25/23 70/257 |
| 2005/0034494 | A1 * | 2/2005 | Meier | E05B 15/0006 70/257 |
| 2005/0277438 | A1 * | 12/2005 | Tilk | B60R 25/2063 455/556.1 |
| 2007/0109097 | A1 * | 5/2007 | Coutermarsh | E05B 47/026 340/5.73 |
| 2009/0195407 | A1 * | 8/2009 | Nakano | H04N 5/4403 340/12.23 |
| 2010/0313612 | A1 | 12/2010 | Eichenstein et al. | |
| 2011/0056253 | A1 * | 3/2011 | Greiner | B62B 3/1404 70/85 |
| 2011/0316683 | A1 * | 12/2011 | Louis | E05B 81/06 340/426.28 |
| 2013/0276488 | A1 * | 10/2013 | Haber | E05B 47/0012 70/57.1 |

* cited by examiner

CROSS CONNECTING LOCKING APPARATUS

BACKGROUND OF INVENTION

There is a multitude of rationales for securing portals such as doors, gates, windows, or other fenestrations. Whether for security, privacy, or protection against the elements, most portals possess a feature that guards against their undesired opening. This is commonly accomplished by locking the portal or by barring it shut. Current technology includes barring a portal by placing a bar across the movable structure, or "door" portion of the portal, and then securing the bar to the nonmovable structure, or "wall" that is on either side of the portal. As each end of the bar is attached to the nonmovable structure such that the bar crosses over the entire width of the movable structure, it is thus "cross connecting."

An inward- or outward-opening portal such as a door or gate can be barricaded from one side because the bar prevents it from swinging in that particular direction. An upward- or downward-opening portal such as a window or garage door can be barricaded similarly, with the additional step of securing the bar to not only the nonmovable structure, but to the movable structure as well; in this manner, the bar attaches the movable structure to the nonmovable structure to preclude opening of the portal.

While a cross connecting bar has the advantage of being much stronger than a lock, there are disadvantages as well. The most salient shortcoming of a cross-connecting bar is that the portal must be barred from the inside. That is, an individual cannot enjoy the security benefits of a cross-connecting bar while the individual is away from the premises. Similarly, an individual could easily become "locked out" if another person, already inside, bars the portal. Thus, it can be said that a cross-connecting bar is a "one-way" security device.

Thus, there is a need in the art for a cross-connecting locking apparatus that attaches to both the movable and nonmovable portal structure and that is remotely operable. Such an apparatus combines the strength of a cross-connecting bar with the "two-way" accessibility of a lock.

BRIEF SUMMARY

Embodiments of the subject invention relate to a cross connecting locking apparatus for portals such as doors, gates, entryways, entrances, hatches, ingresses, garage doors, windows, fenestrations, or any other sort of passageway situated in a larger nonmovable structure. Specific embodiments are remotely operated and can be locked or unlocked under a variety of environmental and/or user-activated triggering mechanisms.

BRIEF DESCRIPTION OF DRAWINGS

In order that a more precise understanding of the above recited invention can be obtained, a more particular description of the invention briefly described above will be rendered by reference to specific embodiments thereof that are illustrated in the appended drawings. It should also be understood that the drawings presented herein may not be drawn to scale and that any reference to or implication of dimensions in the drawings or the following description are specific to the embodiments disclosed. Any variations of these dimensions that will allow the subject invention to function for its intended purpose are considered to be within the scope of the subject invention. Thus, understanding that these drawings depict only typical embodiments of the invention and are not therefore to be considered as limiting in scope, the invention will be described and explained with additional specificity and detail through the use of the accompanying drawings in which:

FIG. 3B shows a key fob that can be utilized in a remote device to communicate with the locking apparatus shown in FIG. 3A.

DETAILED DISCLOSURE

Figure 1A:
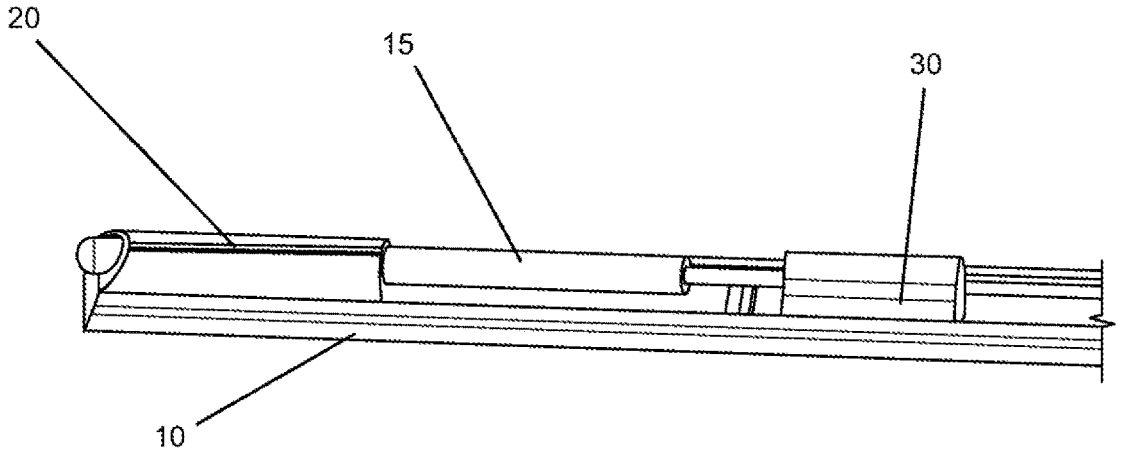
FIG. 1A shows a portion of an embodiment of a cross connecting locking apparatus with a motor, rail, bolt, and bolt carrier.
Figure 1B:
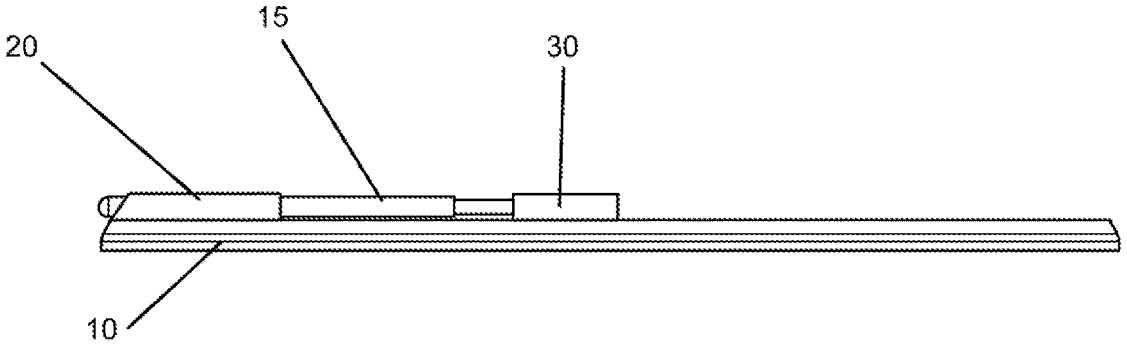
FIG. 1B shows a side view of the portion of the locking apparatus shown in FIG. 1A.
Figure 1C:
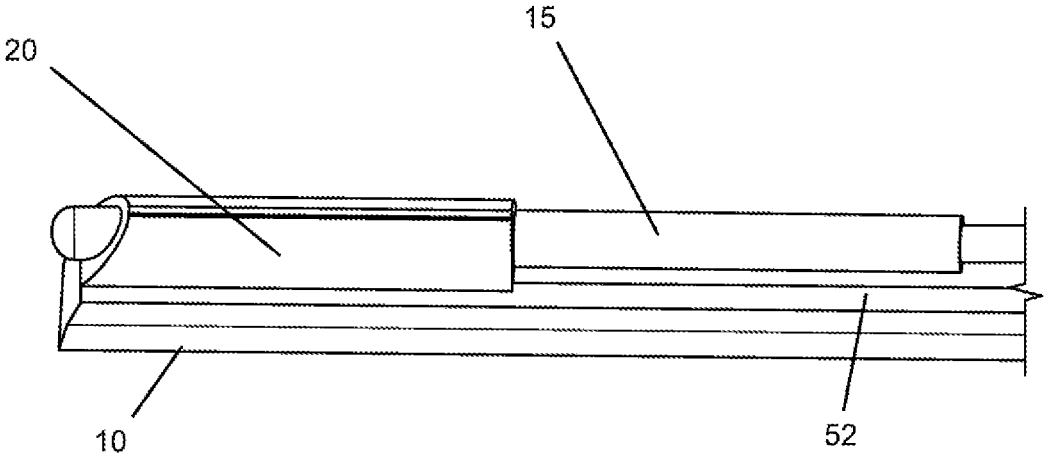
FIG. 1C shows an embodiment with a bolt, bolt carrier, rail, and linear Hall effect sensor.
Figure 1D:
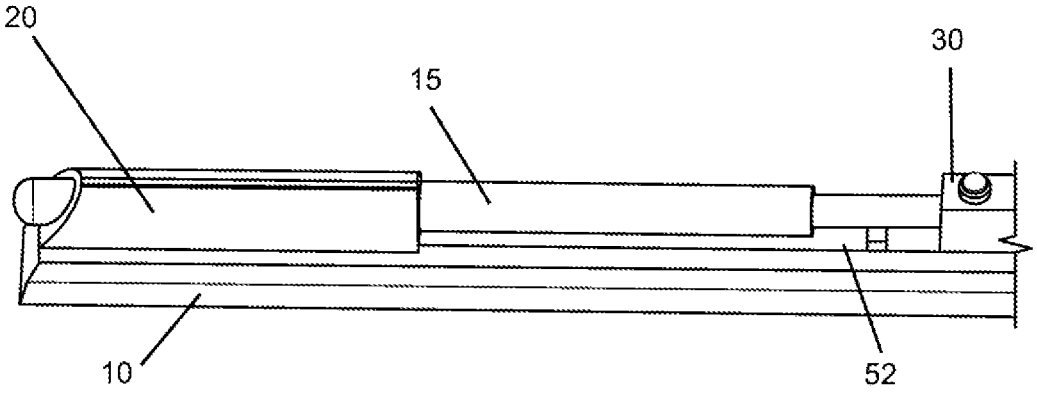
FIG. 1D shows another perspective of FIG. 1C in which the motor is included
Figure 1E:
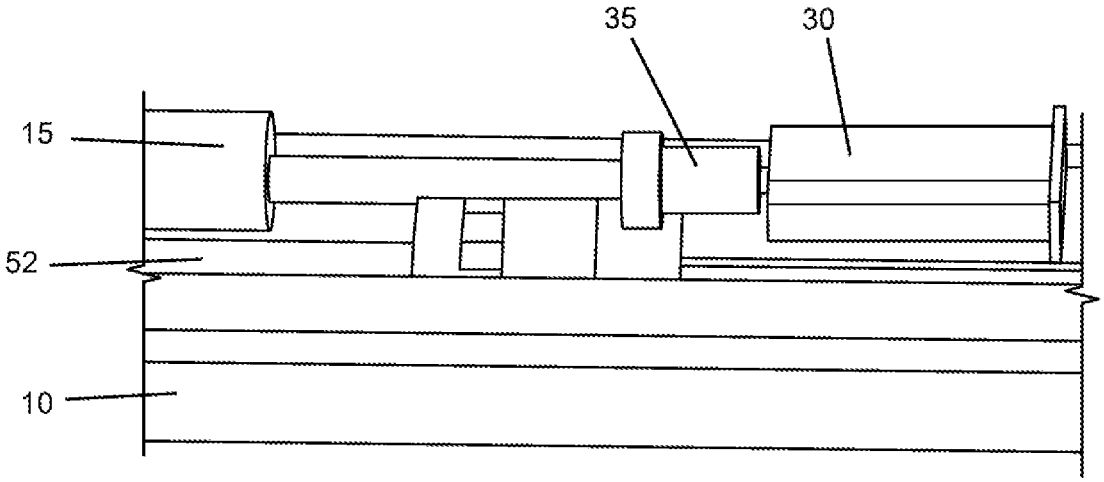
FIG. 1E shows an embodiment in which a linear actuator translates the output of the motor into a linear force.
Figure 1F:
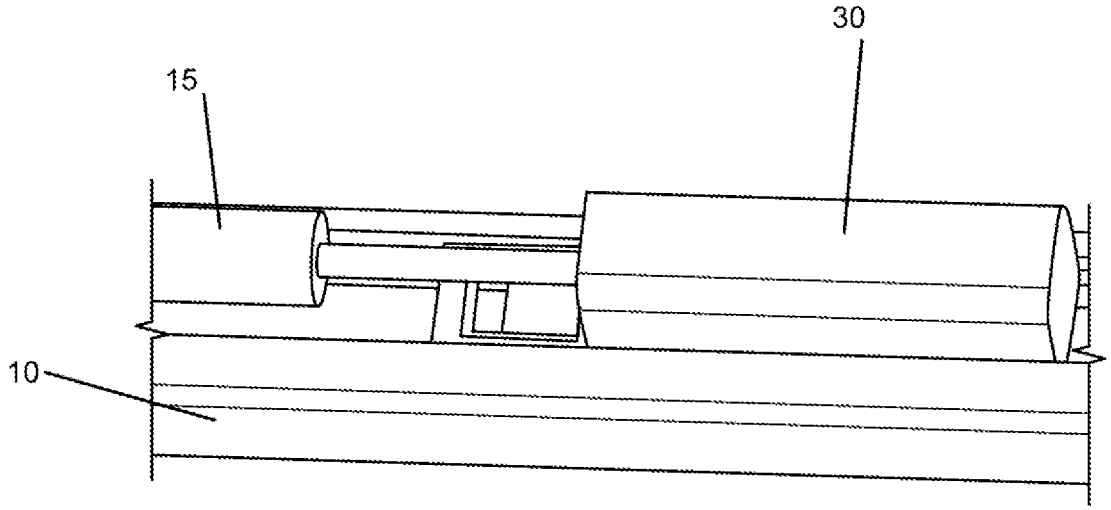
FIG. 1F shows an embodiment with a motor housing that encloses the motor and/or linear actuator.
Figure 1G:
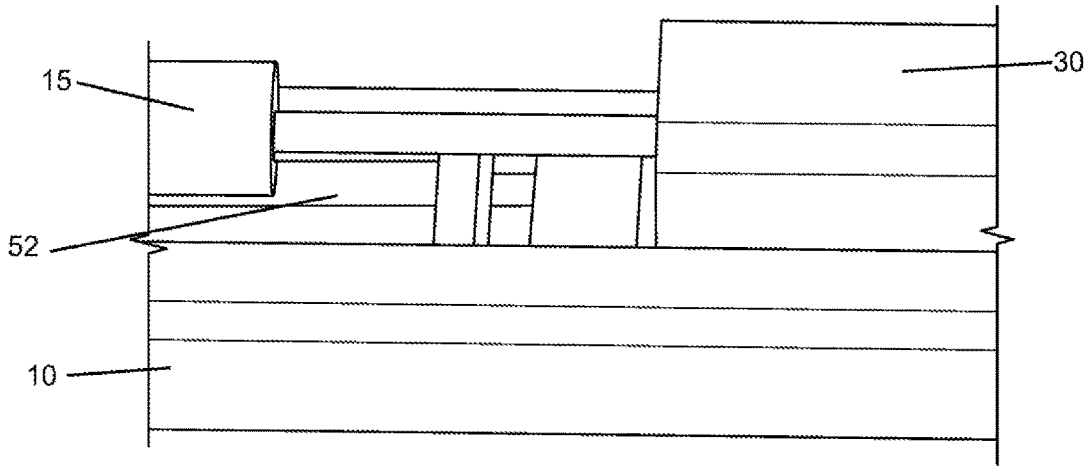
FIG. 1G shows a detailed view of the interconnection of the motor and bolt.
Figure 1H:
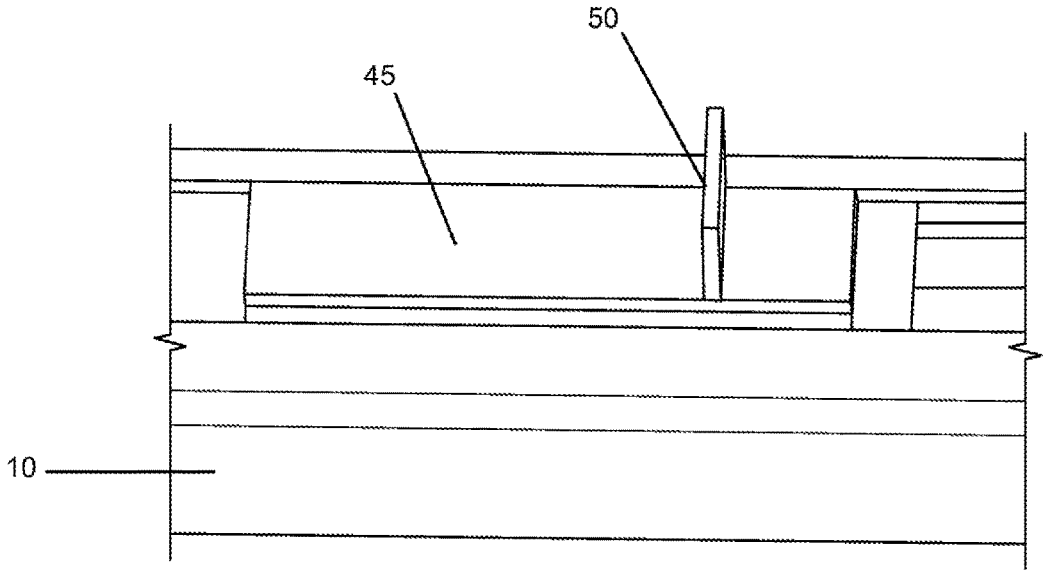
FIG. 1H shows the apparatus with the motor removed to illustrate the location of a master control unit and the master control unit case.
Figure 1I:
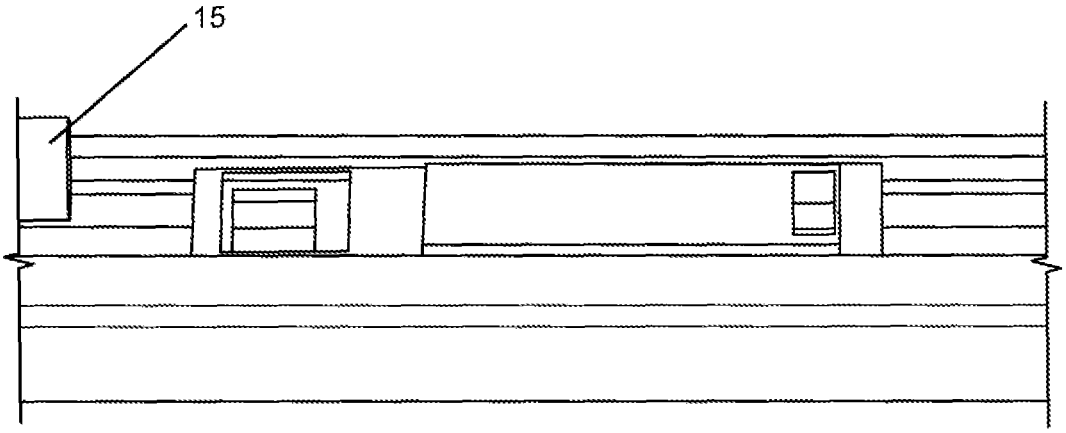
FIG. 1I shows the apparatus with the motor and master control unit removed to illustrate the sled by which the master control unit is attached to the rail.
Figure 1J:
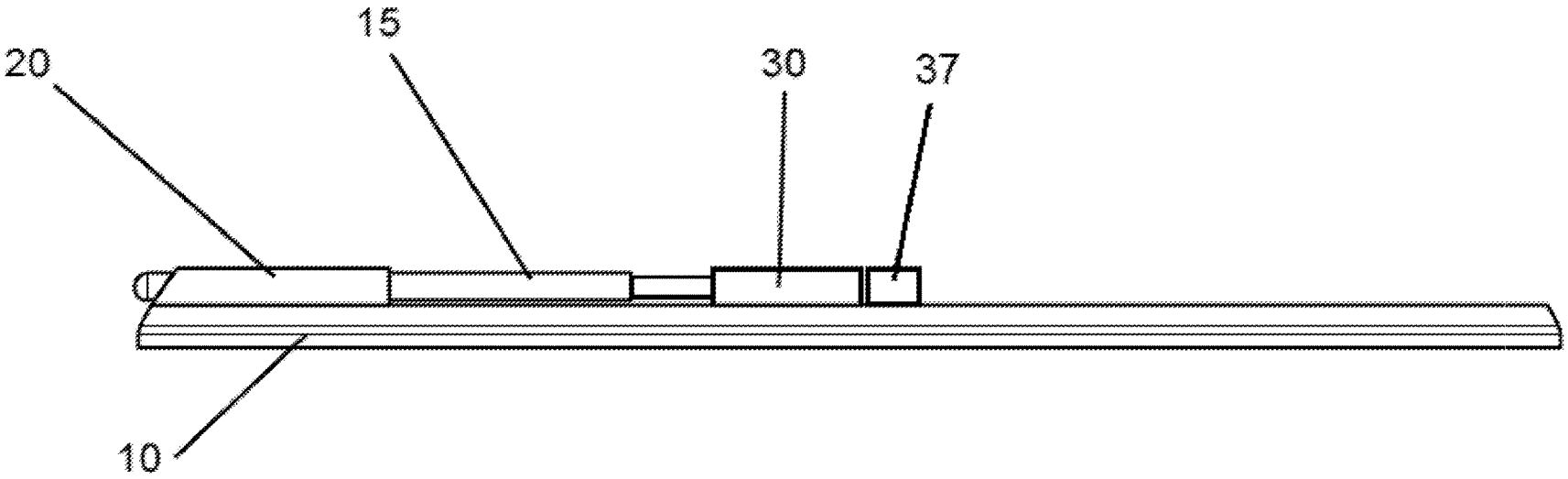
FIG. 1J shows the apparatus with a manual opening mechanism. in accordance with an embodiment of the invention.

Embodiments of the subject invention relate to a cross connecting locking apparatus for portals such as doors, gates, entryways, entrances, hatches, ingresses, garage doors, windows, fenestrations, or any other sort of passageway situated in a larger nonmovable structure. Specific embodiments are remotely operated and can be locked or unlocked under a variety of environmental and/or user-activated triggering mechanisms.

The following detailed description will disclose that the subject invention is particularly useful in the field of securing and weather-proofing a structure. Specific embodiments are directed toward use of the apparatus to bar a door. However, any other applications or uses for the apparatus that are apparent to a person with skill in the art and having benefit of the subject disclosure are contemplated to be within the scope of the present invention.

In the description that follows, a number of terms related to portals in general and doorways in particular are utilized. In order to provide a clear and consistent understanding of the specification and claims, including the scope to be given such terms, the following definitions are provided.

The term "movable structure" as used herein refers to the opening-and-closing component of a portal. This can include, but is not limited to, the portion of a door that is mounted to and swings on hinges, a window that slides up and down within a window frame, the portion of a garage door that goes up and down, and/or any other portal set within a structure or vehicle that is capable of being locked or barred with the embodiments of the subject invention.

The term "nonmovable structure" as used herein refers to that which surrounds the movable structure and through which the portal provides passage. This can include, but is not limited to, the wall in which an entryway or fenestration is set.

Also, as used herein, and unless otherwise specifically stated, the terms "operable communication," "operable connectivity," and "operably connected" mean that the particular elements are connected in such a way that they cooperate to achieve their intended function or functions. The "connection" may be direct, indirect, physical, or remote.

In addition, references to "first," "second," and the like (e.g., first and second motors), as used herein, and unless otherwise specifically stated, are intended to identify a particular feature of which there can be at least two. However, these references are not intended to confer any order in time, structural orientation, or sidedness (e.g. left or right) with respect to a particular feature. Further, references to "first" do not necessarily imply that there is at least two.

References to any particular portal species as used herein, such as a "door," "window," "entryway," "gate," or "ingress" are provided for example purposes only. Unless otherwise specifically stated, embodiments are not intended to be limited in application or scope to any particular species of portal which are apparent to a person with skill in the art and having benefit of the subject disclosure.

Finally, reference is made throughout the application to the "proximal end" and "distal end." As used herein, the proximal end is that end nearest the center of the plate, where the master control unit is located. Conversely, the distal end of the device is that end at the outer span of the rail.

As used in the specification and in the claims, the singular for "a," "an," and "the" include plural referents unless the context clearly dictates otherwise.

FIGS. 1A-1I show an embodiment of a locking apparatus that mounts onto a movable structure (movable structure is not shown). The locking apparatus has a rail 10 that runs at least a portion of the width of the movable structure. Although the embodiment in FIGS. 1A-1I shows one-half of a two bolt embodiment for clarity, the description is applicable to an embodiment with a bolt 15, positioned near one end of the rail 10 and to an embodiment with two bolts at opposite ends of the rail 10. Referring to FIGS. 1A-1I, the bolts 15 are positioned such that each bolt is at one of the opposite ends of the rail 10, such that the first bolt 15 is at a first end of the rail 10 and the second bolt 15 is at the opposite end of the rail 10. The bolts 15 are movably connected to the rail 10 such that the bolts 15 may extend or retract in a direction parallel with the length of the rail 10. In a specific embodiment, each bolt 15 is movably connected to the rail 10 by a bolt carrier 20, which is attached to the respective end of the rail 10. Each bolt 15 is associated with one of the bolt carriers 20 for embodiments having a bolt 15 at each end of rail 10. In one embodiment, the bolts 15 are cylindrical to reduce space. In a specific embodiment, the bolts 15 have a pin extending orthogonally from the side of the bolt 15 that is inserted into a slot in the bolt carrier 20 to keep the bolt 15 from rotating. However, the bolts 15 do not necessarily have to be cylindrical (circular cross-section), and a variety of other cross-sectional shapes can be utilized, such as square, rectangular, oval, elliptical, regular polygonal, irregular polygonal, or any other cross sectional shape that may be appropriate for the application.

Figure 4A:
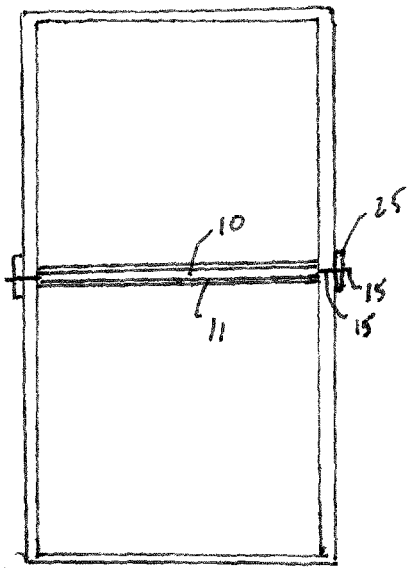
FIGS. 4A and 4B show where two mounts are attached to the nonmovable structure and each configured to receive one of the bolts.
Figure 4B:
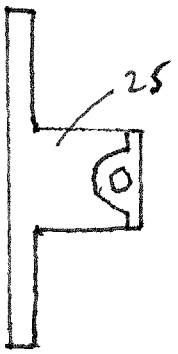

In a specific embodiment, at least one mount 25 is attached to the nonmovable structure on each side of the portal where each mount 25 is configured to receive one of the bolts 15. FIGS. 4A and 4B show an embodiment where two mounts 25 are attached to the nonmovable structure on each side of the portal where each mount 25 is configured to receive one of the two bolts 15. When both bolts 15 are extended into their corresponding mounts 25, the mounts 25 keep the bolt 15 from going in a direction that would allow the movable structure to open, and the apparatus is said to be in the "locked" state. Similarly, when the bolts 15 are not extended into their respective mounts 25, the mounts 25 do no keep the bolts 15 from moving in a direction that would allow the movable structure to open. In a specific embodiment, where the bolts 15 not extended into their respective mounts 25, the bolts 15 are fully retracted into their corresponding bolt carriers 20, the apparatus is said to be in the "unlocked" state.

A specific embodiment can allow one bolt 15 at a time to be extended into the bolt's respective mount 25, such that when the bolt 15 that is on the side of a door that is not hinged to the door frame is extended into the bolt's 15 respective mount 25, the locking apparatus can provide fairly secure locking. In another embodiment where the locking apparatus is mounted on the side of a door and the door is hinged and designed to open toward the other side of the door, the locking apparatus shown in FIGS. 1A-1I can be used with mounts 25 and/or without mounts 25 that receive the bolt 15 such that mount 25 does not allow the bolt 15 to move in a direction away from the non-movable structure. Such a mount can protect the non-movable structure from being scratched and dented by the bolt 15, and, optionally, prevent any movement of the bolt 15 toward the non-movable structure.

Figure 5A:
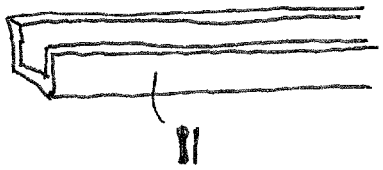
FIGS. 5A and 5B show a plate and rail in accordance with an embodiment of the subject invention, where in FIG. 5A the plate and rail are separated and in FIG. 5A the rail is secured to the plate, and a cover.
Figure 5B:
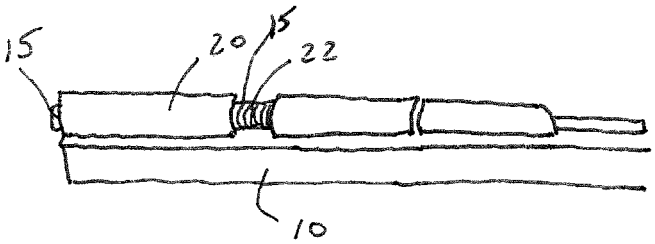

The rail 10 can be mounted directly to the movable structure via one or more attachment mechanisms known in the art, such as via nails, screws, adhesive, and/or tape (e.g. double side tape). In another specific embodiment, the subject locking apparatus can incorporate a plate 11, where the plate 11 is attached to the movable object and the rail 10 is interconnected to the plate 11 such that the rail 10 can, at least in one seating, be secured to the plate 11. FIGS. 5A and 5B show a plate 11 and rail 10 in accordance with an embodiment of the subject invention, where in FIG. 5A the plate 11 and rail 10 are separated and in FIG. 5B the rail 10 is secured to the plate 11, with case 50 covering the plate 11. In a specific embodiment, a plate and rail-plate interconnection system as taught in U.S. Pat. No. 6,932,394, which is incorporated herein by reference in its entirety, can be incorporated with the subject locking apparatus. In a further specific embodiment, the mounts 44 taught in U.S. Pat. No. 6,932,394 can be incorporated with the subject locking apparatus.

Figures 2A, 2B:
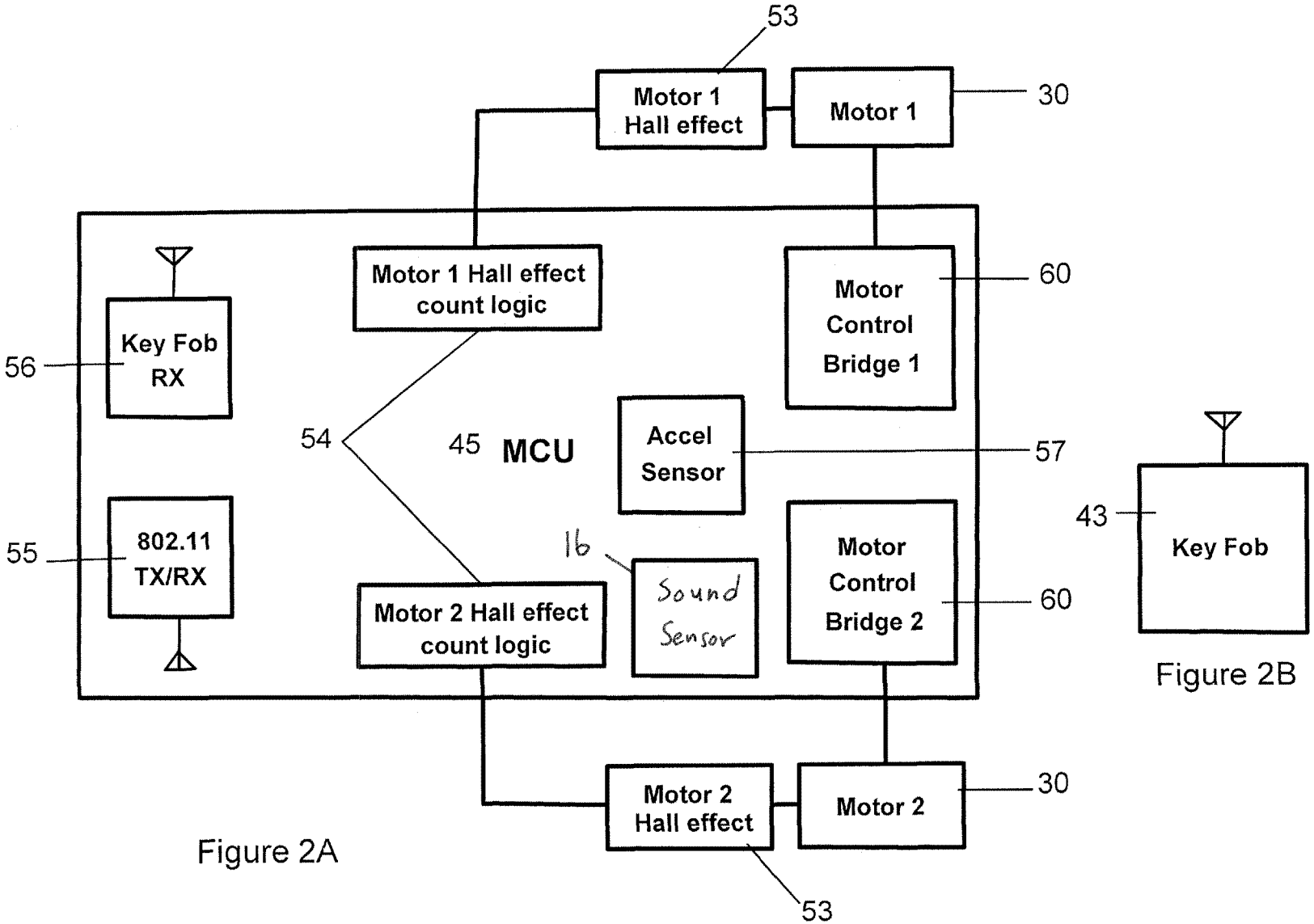
FIG. 2A shows a schematic of a master control unit, two motors, and two Hall effect sensors in accordance with an embodiment of the invention.
FIG. 2B shows a key fob that can be utilized in a remote device to communicate with the locking apparatus shown in FIG. 2A.

In one embodiment, the apparatus is switched between the locked and unlocked state by a master control unit, or MCU 45, which can optionally accept input from a user. The MCU 45 controls at least one motor 30, and preferably a motor 30 for each bolt 15. The MCU 45 can control the motor via a motor control bridge 60. FIGS. 2A and 2B show a schematic of a MCU 45 in accordance with an embodiment of the invention and an optional key fob 43 that can be used to send signals to the MCU 45 and, optionally, receive signals from the MCU 45. The motor 30 can be powered by' a power source 40. The motor 30 then drives the extension and retraction of the bolts 15. In a specific embodiment, a pair of motors 30 is operably connected to a corresponding pair of linear actuators 35, which translate the rotational movement of the motor 30 into linear movement of the bolt 15. The linear actuators 35 are configured such that the linear movement takes place parallel to the rail 10; i.e., along the length of the rail 10. In this manner, each linear actuator 35 is associated with one bolt 15 and imparts a force sufficient to drive the linear extension and retraction of the bolt 15.

In a specific embodiment, the motor is controlled by MCU 45 such that the motor can be controlled by one or more other circuits that can receive input from one or more timing devices, one or more sensors, and/or a user. The MCU 45 can serve to activate and deactivate the pair of motors 30 sequentially, in unison, or in accordance with some other activation pattern. Activation of the motor 30 can initiate either bolt extension or retraction. After the bolts 15 are extended or retracted accordingly, the MCU 45 can deactivate the motors 30. In this manner, the MCU 45 can control the duration of motor function, the distance of extension and/or retraction, and/or other parameters affecting the movement of the bolts 15. In a specific embodiment, the duration of motor activation depends on the desired distance of extension or retraction which in turn can depend on the spacing of the bolt carrier 20 from the mount 25, the spacing of the bolt carrier 20 to the non-movable structure, the relative position of the bolt 15 and bolt carriers 20, and distance the bolt 15 moves per length of time of motor activation. Some mounts 25 may be closer to the bolt carrier 20 than others and this distance is a function of the portal's particular geometry, e.g., the width of a door frame around a door, the relative position of the portion of the mount 25 that receives the bolt 15 and the base of the mount, the placement of the mount 25, and how far the distal end of the bolt carrier 20 is from the edge of the movable structure.

Figure 6:
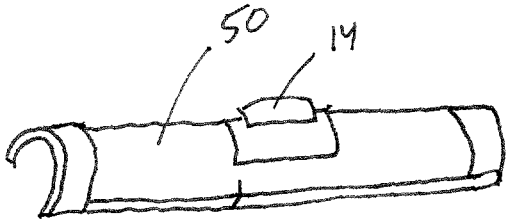
FIG. 6 shows an embodiment incorporating a spring-loaded release.

In a specific embodiment, the MCU 45 is enclosed in a case 50 that has a "lock" and "unlock" button on the exterior for operating the apparatus. FIG. 6 shows a lock and unlock button 14 positioned on case 50 for operating the apparatus, where the lock and unlock button is in operable connectivity with the master control unit, such that when a user presses the lock and unlock button when the apparatus is in the unlocked state, the master control unit switches the apparatus into a locked state, and when a user presses the lock and unlock button when the apparatus is in the locked state, the master control unit switches the apparatus into an unlocked state. Alternatively, the apparatus can have a lock button and an unlock button positioned on case 50 for operating the apparatus, where the lock button and unlock button are in operable connectivity with the master control unit, such that when a user presses the lock button when the apparatus is in the unlocked state, the master control unit switches the apparatus into a locked state, and when a user presses the unlock button when the apparatus is in the locked state, the master control unit switches the apparatus into an unlocked state Additional embodiments may include a case 50 that additionally encloses the motors 30, linear actuators 35, power source 40, bolt carriers 20, and/or the rail 10. A key fob, as shown in FIG. 2B, or other remote device can transmit commands to the MCU 45, and, optionally, receives signals from the MCU 45, such as alarms, warnings, or confirmation of receipt of a command. In an embodiment, the MCU 45 can have a transmitter 55 and/or a receiver 56.

In another embodiment, the apparatus is equipped with a sensor that is capable of counting the number of rotations of the linear actuator 35. The linear actuator's 35 rotation count mathematically corresponds to the length of extension or retraction of the bolts 15. This sensor reports this information back to the MCU 45, which during extension or retraction compares the rotation count against a predetermined number. This predetermined number is the number of rotations that correspond to the desired extension or retraction distance, and once the rotation count reaches this number, the MCU 45 shuts off the motors 30. In a specific embodiment, the sensor is a radial Hall effect sensor 53 and the MCU 45 can have a motor Hall effect counter 54.

Figure 3A:
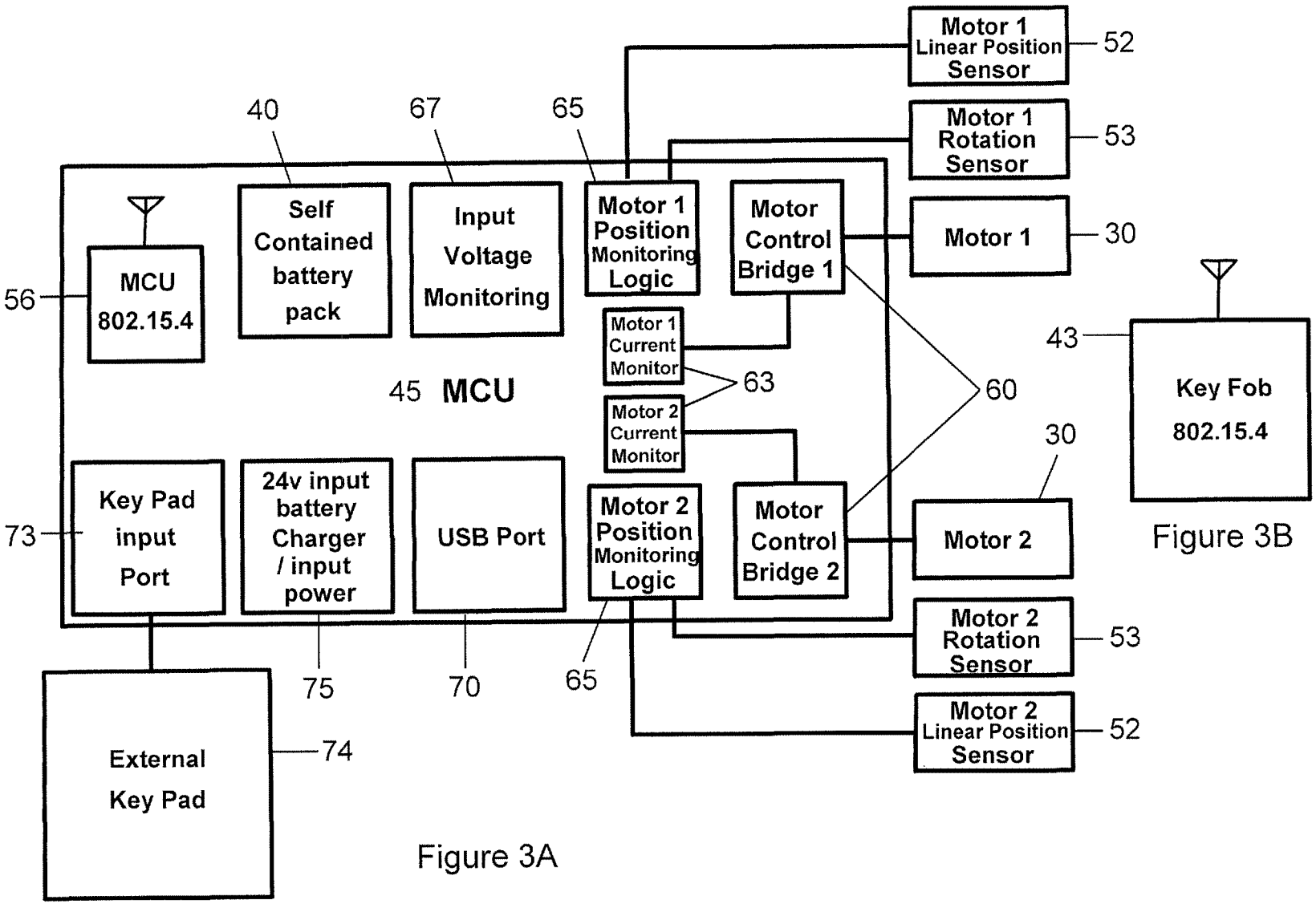
FIG. 3A shows a schematic of a master control unit in accordance with an embodiment of the invention.

FIGS. 3A and 3B show a specific embodiment of the subject locking apparatus. The Key Fob 43 has the ability to send door open/close commands to the MCU 45. The key fob 43 has a built-in learn function that allows the key fob 43 to learn the password from the MCU 45 on initial setup. This function is activated via a simultaneous button press and hold on the key fob 43 and MCU 45 for a predetermined duration. In a specific embodiment, this function can only work if the user has access to both the MCU 45 and the key fob. In a further specific embodiment, both units require a similar set of procedures to be followed in order for both units to be in the proper state for the data transfer.

The MCU 45 is located inside the locking bar apparatus. The MCU 45 can process, and perform all tasks required for the locking apparatus. FIG. 3A shows a block diagram of a specific embodiment of a MCU 45 incorporating many units that can be implemented on the same printed circuit board.

The two motor control bridge half-blocks 60 are responsible for controlling the direction of the bolt 15 movements.

The two motor control monitor half-blocks 63 provide the unit with information regarding the electrical current being drawn by either motor. These blocks can monitor motor health, status, as well as provide the unit with the ability to sense bolt 15 obstructions. These blocks can restore the bolts 15 to the door open state, thus allowing for the removal of the obstruction. This feature enhances the user's safety.

The motor position monitoring logic block 65 allows for the MCU 45 to have knowledge regarding the bolt 15 location at any given time. Coupled with the linear 52 and radial 53 Hall effect sensors, this block provides position information for the MCU. The input voltage monitoring block 67 allows the MCU 45 to monitor the battery state of charge. This also allows the MCU 45 to retract the bolts 15 in the event that the battery state of charge drops below a preset voltage, thus enhancing safety.

The USB port 70 allows the unit to connect to a computer during the set up process.

The MCU 802.15.4 transceiver 56 is a wireless communications block for the locking apparatus. This allows the MCU 45 to take direction from the key fob 43.

A key pad input port 73 and key pad 74 can be used to access the door via a preset key code. This is a hardwired element that can ensure that the user can access their home even if they have lost or damaged the key fob 43.

The external key pad 74 allows the user to actuate the lock by entering a numeric code from the key pad 74 if the key fob is lost, damaged, or not conveniently available. In another embodiment, each bolt 15 houses a magnet that interacts with a linear Hall effect sensor 52 to detect the degree of extension of the bolt 15. In a further embodiment, there is both a linear Hall effect sensor 52 and a radial Hall effect sensor 53 that together enable accurate extension and retraction of the bolt 15.

In a specific embodiment, the power source 40 that can be used to drive the motors 30 is a rechargeable battery. The battery can have a charger that charges the battery while positioning the locking apparatus, or the battery can be removed to be charged. Specific embodiments can have an AC plug for power or an AC/DC converter that provides DC current from the output of an AC outlet. In a further embodiment, the MCU 45 is capable of detecting a low battery. When a low battery is detected, a signal can be provided, such as a beep. In a specific embodiment, when a low battery is detected the MCU 45 can activate unlocking the apparatus in response, thereby preventing a drained battery from rendering the device in an unresponsive locked state. In a specific embodiment, the locking apparatus can remain unlocked until the battery is above a second predetermined threshold of charge, even if the lock command is reversed. In a further specific embodiment, detection of low battery can trigger unlocking of the apparatus only when the device is in a certain state, such as "away from home", but not trigger unlocking the device when in another state such as "at home". In this way the user can avoid being locked out due to a drained battery, but can elect to have the door remain locked when home. The user can use a manual opening mechanism 37 of the apparatus when home even if the battery is low or dead. Such a manual opening mechanism 37 can incorporate an emergency spring-loaded release that pulls the entire motor 30, gearbox, and bolt 15 into an unlocked position with one quick hand release. In a specific embodiment, the manual opening mechanism 37 is a center-mounted button that has an internal spring to apply constant outward force. The button separates two spring-loaded motors 30, which are restrained by a lip. Once the button is pressed, the lip holding the two spring-loaded motors 30 releases and the two motors 30 are forced inward toward one another, which assures that the bolts 15 are pulled out of the wall mounts 25 so that the door may be opened. In an embodiment, such a release complies with the National Fire Protection Life Safety Code for door hardware. In specific embodiments, the apparatus may be equipped with a battery charge level indicator that provides a helpful visual or auditory reference to the user as to the battery's current level of charge. A visual battery charge level indicator may include a four-bar style display, where each bar roughly corresponds to one quarter of the battery's capacity. A specific embodiment displays a digital value that represents the battery's current charge as a percentage of its total charge capacity. Specific embodiments employ an auditory cue, visual cue, text, phone call, email message, and/or a signal sent to a remote device, to alert the user to a low battery.

In a specific embodiment, the MCU 45 is configured to transmit and/or receive data with a remote device. In one embodiment, this remote device may be a sound speaker that emits a noise upon occurrence of a condition, such as the apparatus locking or unlocking, or the battery reaching a certain charge level. More advanced embodiments include a remote device that communicates with the MCU 45. Such devices may communicate wiredly or wirelessly, and include cell phones, key fobs, PDAs, computers, tablets, and other wired or wireless devices. Such a remote device can send one or more of the following commands: unlock, lock, check battery, switch to or out of "away from home" state, "at home" state, or other state, enable the locking apparatus to detect smoke alarms or not, or other signals. In a specific embodiment, the locking apparatus can be unlocked or locked after receiving specific voice commands, or can receive commands over the internet or by phone. This list of remote devices is not intended to be comprehensive and other remote devices which are apparent to a person with skill in the art are contemplated to be within the scope of the present invention. In other embodiments, the remote device issues to the user some sort of alert upon occurrence of a certain condition, such as the MCU 45 detecting a low battery charge level, or unlocking or locking of the apparatus. In a further embodiment, the user may remotely lock and unlock the apparatus with the remote device. If the remote device is lost or broken, a new remote device can be synchronized with the MCU 45 by having the new remote device signal the MCU 45, for example, by holding down a button on the MCU 45, or remote device, or both, to initiate passing of an identification address from the remote device to the MCU 45 and/or from the MCU 45 to the remote device. In this way, a user can re-key a new remote device to the same locking apparatus in case of loss or disablement of the old remote device, or desire for a duplicate or additional remote device.

In another embodiment, the motor 30 and linear actuator 35 achieve bolt 15 extension with a force that is limited in magnitude such that the pressure applied by the bolt 15 to an object, such as a users' finger, will not seriously injure the user's finger if the user's finger is placed in the gap between the bolt 15 and the mount 25. In a specific embodiment, such force results in a pressure at the tip of the bolt 15 of less than 5 $lb/in^2$, less than 4.5 $lb/in^2$, less than 4.0 $lb/in^2$, less than 3.5 $lb/in^2$, and/or less than 3.0 $lb/in^2$. This safety feature is not to be limited to the user; non-users and animals are also contemplated, as is anything else apparent to a person with skill in the art. A specific embodiment incorporates a force sensor or an accelerometer 57 that detects, for example, tampering with the device and/or attempts at forceful entry and communicates this to the MCU 45. Upon receipt of such an indication by the force sensor or accelerometer 57, the MCU 45 can trigger an alert to the user, such as, an alarm (e.g., visual, audible and/or electronic message such as a text, email phone call) at the apparatus, at one or more other locations, and/or transmitted to the remote device or other electronic device.

Another safety-minded embodiment has a sound sensor 16 capable of sensing an audible alarm issuing from an alarm device, such as a fire alarm, personal whistle, user's voice, fog horn, or other sound producing device that the sound sensor is configured to detect. When the audible alarm sounds, the sound sensor 16 detects the audible alarm and communicates this to the MCU 45, which can unlock the apparatus, lock the apparatus, or lock or unlock the apparatus depending on the current lock status, apparatus mode or other setting, and/or the type of alarm. In a specific embodiment, the sound sensor 16 is configured to detect the sound of a fire alarm inside of the dwelling in which the apparatus is positioned, and unlock the apparatus in the event that a fire alarm sound is detected. In further embodiments, the sound sensor 16 can be configured to detect a fire alarm sound from a fire alarm outside of the dwelling, such as a hallway, and again unlock the apparatus so users in the dwelling can exit. Types of alarm devices include fire alarms, smoke detectors, carbon monoxide detectors, and radon detectors, but other audible alarms that would be apparent to a person skilled in the art are also contemplated.

EMBODIMENTS

Embodiment 1

A cross connecting locking apparatus, comprising:

a rail, wherein the rail is configured to attach to a movable structure interconnected to a movable structure, wherein the movable structure has a first side, a second side, a top, a bottom, and the nonmovable structure is positioned on the first side and the second side when the movable structure is in a closed position with respect to the nonmovable structures, wherein the rail has a first end and a second end and is configured to be attached to the plate;

a first bolt movably retained within and extended from a first bolt carrier, wherein the first bolt carrier is operably connected to the first end of the rail;

a first mount, wherein the first mount is configured to be attached to the nonmovable structure adjacent to the first side of the movable structure and the first mount is configured to receive the first bolt;

a first motor;

a first actuator, wherein the first actuator is operably connected to the first bolt and the first motor, such that actuation of the first actuator by the first motor either extends the first bolt from the first bolt carrier or retracts the first bolt toward the first bolt carrier, wherein the first actuator is configured to extend the first bolt to an extended state or retract the first bolt to a retracted state, wherein the first extended state is achieved when the first motor actuates the first actuator, such that when the movable structure is in the close position the first mount receives the first bolt, and wherein the retracted state is achieved when the first motor actuates the first actuator such that when the movable structure is in the closed position the first bolt is retracted from the first mount and the movable structure is free to transition from the closed position to an open position, a master control unit, wherein the master control unit is configured to control the first motor so as to actuate the first actuator to either extend or retract the first bolt between the extended state and the retracted state.

Embodiment 2

The apparatus according to Embodiment 1, further comprising:

a second bolt movably retained within and extended from a second bolt carrier, wherein the second bolt carrier is operably connected to the second end of the rail;

a second mount, wherein the second mount is configured to be attached to the nonmovable structure adjacent to the second side of the movable structure and the second mount is configured to receive the second bolt;

a second motor;

a second actuator, wherein the second actuator is operably connected to the second bolt and the second motor, such that actuation of the second actuator by the second motor either extends the second bolt from the second bolt carrier or retracts the second bolt toward the second bolt carrier, wherein the second actuator is configured to extend the first bolt to a second extended state or retract the second bolt to a second retracted state, wherein the second extended state is achieved when the second motor actuates the second actuator, such that when the movable structure is in the closed position the second mount receives the second bolt, and wherein the second retracted state is achieved when the second motor actuates the second actuator, such that the second bolt is retracted from the second mount and the movable structure is free to transition from the closed position to the open position; and wherein the master control unit is configured to control the second motor so as to actuate the second actuator to either extend or retract the second bolt between the second extended state and the second retracted state.

Embodiment 3

The apparatus according to Embodiment 1, further comprising a plate, wherein the plate is configured to attach to the movable structure, wherein the rail is configured to attach to the movable structure by interconnecting to the plate when the plate is attached to the movable structure.

Embodiment 4

The apparatus according to Embodiment 2, wherein actuation of the first actuator to extend or retract the first bolt between the first extended state and the first retracted state and actuation of the second actuator extend or retract the second bolt between the second extended state and the second retracted state is performed in unison to define a locked state and an unlocked state for the apparatus, wherein the locked state is defined by both bolts being in the extended state, and wherein the unlocked state is defined by both bolts being in the retracted state.

Embodiment 5

The apparatus according to Embodiment 2, further comprising:

wherein the first actuator is a first linear actuator, wherein the second actuator is a second linear actuator, wherein the first linear actuator is operably connected to the first bolt and the second linear actuator is operably connected to the second bolt, wherein the first motor is operably connected to the first linear actuator and the second motor is operably connected to the second linear actuator, wherein the first motor generates a rotational movement that the first linear actuator translate into a linear movement of the first bolt to extend or retract the first bolt, wherein the second motor generates a rotational movement that the second linear actuator translate into a linear movement of the second bolt to extend or retract the second bolt.

Embodiment 6

The apparatus according to Embodiment 5, further comprising a first sensor wherein the first sensor senses rotational movement of the first linear actuator to detect a number of rotations experienced by the first linear actuator, wherein the master control unit deactivates the first motor upon the sensor detecting a predetermined number of rotations experienced by the first linear actuator.

Embodiment 7

The apparatus according to Embodiment 6, wherein the sensor is a Hall Effect sensor.

Embodiment 8

The apparatus according to Embodiment 2, wherein the first bolt is extended by the first actuator and the second bolt is extended by the second actuator with a force less than or equal to a predetermined force.

Embodiment 9

The apparatus according to Embodiment 2, further comprising a cover; a lock button and an unlock button positioned on the cover, wherein the lock button and unlock button are in operable connectivity with the master control unit, wherein when a user presses the lock button, the master control unit switches the apparatus into the locked state, wherein when a user presses the unlock button, the master control unit switches the apparatus into the unlocked state.

Embodiment 10

The apparatus according to Embodiment 2, further comprising a power source, wherein the power source provides power to the first motor and provides power to the second motor.

Embodiment 11

The apparatus according to Embodiment 10, wherein the power source is a rechargeable battery.

Embodiment 12

The apparatus according to Embodiment 11, further comprising a battery charge level indicator, wherein the battery charge level indicator indicates a charge level of the battery.

Embodiment 13

The apparatus according to Embodiment 12, wherein the battery charge level indicator comprises a four bar display.

Embodiment 14

The apparatus according to Embodiment 12, wherein the battery charge level indicator displays a numerical value that is a percentage, wherein the percentage is the current amount of charge divided by the maximum amount of charge.

Embodiment 15

The apparatus according to Embodiment 11, wherein the master control unit switches the apparatus into the unlocked state when the master control unit detects that the battery charge level falls below a minimum threshold battery charge level.

Embodiment 16

The apparatus according to Embodiment 1, further comprises a receiver, wherein the receiver allows for operable communication with a remote device such that one or more commands can be received by the apparatus from the remote device.

Embodiment 17

The apparatus according to Embodiment 16, wherein the remote device is selected from the group consisting of a cell phone, a key fob, a PDA, a networked computer, a tablet, a remote sound speaker, an 802.11 WLAN enabled device, a 802.15.4 enabled device, and a Bluetooth® enabled device.

Embodiment 18

The apparatus according to Embodiment 16, further comprising a transmitter, wherein the transmitter sends an alert to the remote device when the battery charge level falls below a minimum threshold battery charge level.

Embodiment 19

The apparatus according to Embodiment 16, wherein a user can remotely switch the apparatus between the locked state and the unlocked state via the remote device.

Embodiment 20

The apparatus according to Embodiment 16, wherein the master control unit is paired with the remote device by communicating an identification address to the remote device.

Embodiment 21

The apparatus according to Embodiment 18, further comprising a sensor, wherein the sensor is a force sensor and/or accelerometer configured to defect an impact force applied to the apparatus and/or tampering with the apparatus, wherein when the sensor detects the impact force and/or tampering, the apparatus transmits an alert to the remote device.

Embodiment 22

The apparatus according to Embodiment 2, further comprising a sound sensor capable of sensing an auditory alarm, wherein when the sound sensor senses the auditory alarm, the master control unit switches the apparatus into the unlocked state if the apparatus is in a first state and the master control unit switches the apparatus into the locked state if the apparatus is in a second state.

Embodiment 23

The apparatus according to Embodiment 22, wherein the auditory alarm is produced by an alarm device, wherein the alarm device is selected from the group consisting of a fire detector, a smoke detector, and a carbon monoxide detector.

Embodiment 24

The apparatus according to Embodiment 2, further comprising a spring-biased release mechanism, wherein when a user manually activates the release mechanism, the first bolt is transitioned into the first retracted state and the second bolt is transitioned into the second retracted state.

Embodiment 25

The apparatus according to Embodiment 8, wherein the predetermined force is such that the pressure exerted by the bolt is no greater than the value selected from the list consisting of: 3.0 $lb/in^2$. 3.5 $lb/in^2$, 4.0 $lb/in^2$, 4.5 $lb/in^2$, and 5.0 $lb/in^2$.

The invention claimed is:

1. A locking apparatus system, comprising:

a rail;

the rail extending a length between opposing first and second ends;

the rail operatively connected to a door having a width that extends between opposing first and second sides, wherein nonmovable structure is positioned adjacent the first side and the second side of the door;

wherein the door has an interior side and an exterior side;

wherein the rail is mounted on the interior side of the door;

a first mount connected to the nonmovable structure positioned adjacent the first end of the rail, and a second mount connected to the nonmovable structure positioned adjacent the second end of the rail;

a first bolt operatively connected adjacent the first end of the rail, and a second bolt operatively connected adjacent the second end of the rail;

wherein the first bolt and the second bolt each are configured to move between an extended position and a retracted position;

wherein when the first bolt and second bolt are in their respective extended positions, the first bolt extends past the first end of the rail and is received by the first mount, and the second bolt extends past the second end of the rail and is received by the second mount, thereby locking the door in a closed position;

wherein when the first bolt and second bolt are in their respective retracted positions, the first bolt is free from locking engagement with the first mount, and the second bolt is free from locking engagement with the second mount, thereby unlocking the door and allowing the door to be opened and closed;

a first motor operatively connected to the first bolt, and a second motor operatively connected to the second bolt;

a motor control unit;

the motor control unit operatively connected to the first motor and the second motor and configured to control operation of the first motor and the second motor;

wherein when activated, the motor control unit is configured to simultaneously activate the first motor and the second motor, thereby simultaneously extending or retracting the first bolt and the second bolt between their respective extended or retracted positions;

a manual opening mechanism;

the manual opening mechanism is accessible from the interior side of the door;

wherein when the manual opening mechanism is operated, the first bolt and the second bolt are retracted to their respective retracted positions, allowing the door to be opened;

wherein when motor control unit cannot be activated to control operation of the first motor and the second motor to simultaneously retract first bolt and the second bolt to their respective retracted positions, the manual opening mechanism is operated to cause the retraction of the first bolt and the second bolt to their active retracted positions.

2. The system of claim 1, further comprising a receiver operatively connected to the motor control unit, and a remote device in operative wireless connection with the receiver, wherein the remote device is configured to transmit commands to the motor control unit, thereby locking or unlocking the door.

3. The system of claim 1, further comprising a case operatively connected to the rail, the case having at least one button operatively connected to the motor control unit, wherein when activated, the at least one button serves to extend or retract the first bolt and the second bolt.

4. The system of claim 1, further comprising a case operatively connected to the rail, the case having at least one button operatively connected to the motor control unit, wherein when the first bolt and the second bolt are in their respective extended positions and the at least one button is activated, the motor control unit retracts the first bolt and the second bolt, thereby unlocking the door, and wherein when the first bolt and the second bolt are in their respective retracted positions, and the at least one button is activated, the motor control unit extends the first bolt and second bolt, thereby locking the door.

5. The system of claim 1, further comprising a first linear actuator operatively connected to the first motor and the first bolt and a second linear actuator operatively connected to the second motor and the second bolt, wherein the first linear actuator and the second linear actuator are configured to translate rotational movement of the first motor and the second motor into linear movement of the first bolt and the second bolt, respectively.

6. The system of claim 1, further comprising a power source operatively connected to the motor control unit, wherein the power source is formed of at least one battery.

7. The system of claim 1, further comprising a power source operatively connected to the motor control unit, wherein the power source is formed of at least one rechargeable battery.

8. The system of claim 1, further comprising a power source operatively connected to the motor control unit, wherein the power source is formed of at least one battery, and further comprising a battery monitoring system, wherein the battery monitoring system is configured to monitor the charge of the at least one battery and when the charge reaches a predetermined threshold the motor control unit simultaneously activates the first and the second motor, thereby simultaneously retracting the first bolt from locking engagement with the first mount, and the second bolt from locking engagement with the second mount, thereby unlocking the door and allowing the door to be opened and closed.

9. The system of claim 1, further comprising a power source operatively connected to the motor control unit, wherein the power source is formed of at least one battery, and further comprising a battery monitoring system, wherein the battery monitoring system is configured to monitor the charge of the at least one battery and when the charge reaches a predetermined threshold when the first bolt and the second bolt are in an extended position, and the system is in an "away from home" state, the motor control unit simultaneously activates the first and the second motor, thereby simultaneously retracting the first bolt from locking engagement with the first mount, and the second bolt from locking engagement with the second mount, thereby unlocking the door and allowing the door to be opened and closed.

10. The system of claim 1, wherein when a low battery charge state is detected by the motor control unit, a signal indicating the low battery state is transmitted as an indication to a user.

11. The system of claim 1, wherein when a low battery charge state is detected, the motor control unit simultaneously activates the first and the second motor, thereby simultaneously retracting the first bolt from locking engagement with the first mount, and the second bolt from locking engagement with the second mount, thereby unlocking the door and allowing the door to be opened and closed.

12. The system of claim 1, further comprising battery charge level indicator, wherein the battery charge level indicator provides a visual indication of a charge level of at least one battery operatively connected to the system.

13. The system of claim 1, further comprising a force sensor, wherein the force sensor is configured to detect attempts at forceful entry.

14. The system of claim 1, further comprising a force sensor, wherein the force sensor is configured to detect attempts at forceful entry, wherein the force sensor is an accelerometer.

15. The system of claim 1, further comprising a force sensor, wherein the force sensor is configured to detect attempts at forceful entry, wherein when the force sensor detects an attempt at a forceful entry, a signal is transmitted to a user.

16. A locking apparatus system, comprising:

a rail;

the rail extending a length between opposing first and second ends;

the rail operatively connected to a door having a width that extends between opposing first side and second sides, wherein nonmovable structure is positioned adjacent the first side and second side of the door;

wherein the door has an interior side and an exterior side;

wherein the rail is mounted on the interior side of the door;

a first mount connected to the nonmovable structure positioned adjacent the first end of the rail, and a second mount connected to the nonmovable structure positioned adjacent the second end of the rail;

a first bolt operatively connected adjacent the first end of the rail, and a second bolt operatively connected adjacent the second end of the rail;

wherein the first bolt and the second bolt each are configured to move between an extended position and a retracted position;

wherein when in their respective extended positions, the first bolt is received by the first mount and the second bolt is received by the second mount, thereby locking the door in a closed position;

wherein when in their respective retracted positions, the first bolt is free from locking engagement with the first mount and the second bolt is free from locking engagement with the second mount thereby allowing the door to be opened and closed;

a first motor operatively connected to the first bolt and a second motor operatively connected to the second bolt;

a motor control unit;

the motor control unit operatively connected to the first motor and the second motor and configured to control operation of the first motor and the second motor;

wherein when activated, the motor control unit s configured to simultaneously operate the first motor and the second motor, thereby simultaneously extending or retracting the first bolt and the second bolt between their respective extended or retracted positions;

a force sensor;

wherein the force sensor is configured to detect attempts at forceful entry;

wherein when the force sensor detects an attempt at a forceful entry, a signal is transmitted to a user;

a manual opening mechanism;

the manual opening mechanism accessible from the interior side of the door;

wherein when the manual opening mechanism is operated, the first bolt and the second bolt are retracted to their respective retracted positions, allowing the door to be opened;

wherein when the motor control unit cannot be activated to control operation of the first motor and the second motor to simultaneously retract the first bolt and the second bolt to their respective retracted positions, the manual opening mechanism is operated to cause the retraction of the first bolt and the second bolt to their respective retracted positions.

17. The system of claim 16, wherein the signal is a visual alarm, an audible alarm, an electronic message, a text message, an email, a voice mail, or a phone call.

18. The system of claim 16, further comprising a power source operatively connected to the motor control unit;

wherein the power source is formed of one or more batteries, a battery monitoring system operatively connected to the power source and the motor control unit;

wherein when the charge of the power source reaches a predetermined threshold, the motor control is configured to simultaneously activate the first and the second motor, thereby simultaneously retracting the first bolt and the second bolt, thereby unlocking the door and allowing the door to be opened and closed.

* * * * *